US008615953B2

(12) United States Patent
Cappelle

(10) Patent No.: US 8,615,953 B2
(45) Date of Patent: Dec. 31, 2013

(54) PANEL, MORE PARTICULARLY FLOOR PANEL

(75) Inventor: Mark Cappelle, Staden (BE)

(73) Assignee: Flooring Industries Limited, SARL, Bertrange (LU)

( * ) Notice: Subject to any disclaimer, the term of this patent is extended or adjusted under 35 U.S.C. 154(b) by 82 days.

(21) Appl. No.: 13/378,228

(22) PCT Filed: Jun. 20, 2010

(86) PCT No.: PCT/IB2010/052812

§ 371 (c)(1),
(2), (4) Date: Dec. 14, 2011

(87) PCT Pub. No.: WO2011/001326

PCT Pub. Date: Jan. 6, 2011

(65) Prior Publication Data

US 2012/0096801 A1 Apr. 26, 2012

(30) Foreign Application Priority Data

Jun. 29, 2009 (BE) ..... 2009/0389

(51) Int. Cl.
*E04B 2/00* (2006.01)

(52) U.S. Cl.
USPC ..... 52/588.1; 52/590.2; 52/589.1; 52/591.1

(58) Field of Classification Search
USPC ..... 52/390, 392, 578, 586.1, 589.1, 591.1, 52/590.2, 590.1, 592.3, 592.1, 572, 570, 52/588.1; 403/298, 375, 381
See application file for complete search history.

(56) References Cited

U.S. PATENT DOCUMENTS 6,536,178 B1 * 3/2003 P.ang.lsson et al. ..... 52/589.1
6,772,568 B2 * 8/2004 Thiers et al. ..... 52/592.1
8,037,656 B2 * 10/2011 Liu et al. ..... 52/589.1
8,181,416 B2 * 5/2012 Pervan et al. ..... 52/586.2

(Continued)

FOREIGN PATENT DOCUMENTS

DE 10 2004 001 363 A1 8/2005
DE 10 2007 042840 A1 3/2009

(Continued)

OTHER PUBLICATIONS

International Search Report and Written Opinion issued in PC/IB2010/052812, May 15, 2012.

(Continued)

*Primary Examiner* — Chi Q Nguyen
(74) *Attorney, Agent, or Firm* — Workman Nydegger

(57) ABSTRACT

A panel having a core and at least two opposite edges with coupling parts at two opposite edges. The coupling parts of the panels can be coupled to each other by means of a downward movement, such that a locking is obtained in the plane of the panels and perpendicular to the edges, as well as perpendicular to the plane of the panels. The coupling parts at the two edges comprise locking parts ensuring locking in the direction perpendicular to the plane of the panels, and at least one of these locking parts forms part of a flexible portion made in one piece with the core. The flexible portion is bendable at least in the plane of the panel. The panel includes at least one support portion which forms a support against bending of the flexible portion in a direction transverse to the plane of the coupled panels.

23 Claims, 5 Drawing Sheets

(56) References Cited

U.S. PATENT DOCUMENTS

| | | | | |
|---|---|---|---|---|
| 8,245,478 | B2 * | 8/2012 | Bergelin et al. | 52/592.1 |
| 8,381,477 | B2 * | 2/2013 | Pervan et al. | 52/586.2 |
| 8,429,870 | B2 * | 4/2013 | Chen et al. | 52/582.1 |
| 2010/0037550 | A1 | 2/2010 | Braun | |

FOREIGN PATENT DOCUMENTS

| | | | |
|---|---|---|---|
| EP | 1 350 904 | A2 | 4/2003 |
| WO | 97/47834 | A1 | 12/1997 |
| WO | 2004/003314 | A1 | 1/2004 |
| WO | 2007/002088 | A1 | 2/2007 |
| WO | 2007/141605 | A2 | 12/2007 |
| WO | 2008/116623 | A1 | 10/2008 |
| WO | 2009/033623 | A1 | 3/2009 |

OTHER PUBLICATIONS

International Search Report and Written Opinion issued in BE 2009/0389, May 18, 2010.

* cited by examiner

PANEL, MORE PARTICULARLY FLOOR PANEL

BACKGROUND

1. Field of the Disclosure

This invention relates to a panel and more particularly a floor panel.

In particular, it relates to a panel of the type wherein the panel comprises a core, an upper side, a bottom side and at least two opposite edges; wherein coupling parts are provided at said two opposite edges; wherein these coupling parts have such a configuration that two of such panels can be coupled to each other by means of a downward movement of one of the panels in respect to the other, such that a locking is obtained in the plane of the panels and perpendicular to said edges, as well as perpendicular to the plane of the panels; wherein the coupling parts at said two edges comprise locking parts ensuring said locking in the direction perpendicular to the plane of the panels, wherein at least one of these locking parts forms part of a flexible portion made in one piece with said core, said flexible portion extending along the respective edge and being bendable at least in the plane of the panel, as a result of connecting two of such panels.

2. Related Art

Panels of this type are known from WO 2008/116623 and WO 2009/033623 and show the feature that they can combine various advantageous characteristics in the same panel. As the flexible portion is made in one piece with the core, a relatively inexpensive production is possible, as such coupling parts can be realized exclusively by machining treatments and it is not necessary to provide separate elements in the edge. As the panels, at two edges, are provided with coupling parts allowing to couple such panels to each other by means of a downward movement, in the case of floor panels, they can be installed, when being provided with a suitable profiled part at the other edges, by making use of the user-friendly "angle-push" technique, wherein each new panel to be installed is connected to the previous row of panels by means of a turning technique, and wherein, as a result of the downward movement associated therewith, it is automatically coupled to the preceding panel in the same row, via the coupling parts comprising said flexible portion.

By making use of a flexible element which is bendable in the plane of the panel and also extends substantially in the plane of the panel, said coupling parts are particularly suited for realizing a so-called "push-lock" coupling in a core material which, in its plane, has a higher tensile strength than perpendicularly to its plane, which mostly is the case with wood composite board. In this manner then in such case at least the necessary flexibility can be guaranteed, on the one hand, whereas, on the other hand, it is excluded that with the occurring forces a tearing-off of the flexible portion from the remainder of the core will happen.

More specifically, this has enabled realizing a so-called "push-lock" coupling in one piece in MDF/HDF, in such a manner that, thanks to the construction thereof, a good bending is possible for realizing a snap effect, whereas weak portions, in which a shearing-off may occur, are excluded.

According to the embodiments which are described in WO 2008/116623 and WO 2009/033623, the flexible portion consists of a lip which is attached at its distal extremities, however, which moreover, at the height of the zone where it is active as a locking part, is entirely made free all around in order to supply the intended flexibility. These known embodiments have the disadvantage that the flexible part made as a lip, in the coupled condition of two panels, can perform a considerable deformation perpendicular to the plane of the panels. A consequence thereof is that, under certain irregular loads, it is impossible to ensure that the panels will not show any height differences at their decorative surfaces. When, for example, in the case of floor panels a panel is heavily loaded directly adjacent to its coupled edge, for example, by the foot of a heavy piece of furniture, said lip will bend in a plane perpendicular to the panels, whereby the most heavily loaded panel possibly will sink deeper into the mostly applied elastically impressible underlay than the adjacent panel.

SUMMARY OF THE INVENTION

The invention aims at a solution which remedies this disadvantage or at least minimizes it.

To this aim, the invention, according to a first aspect, relates to a panel of the above-mentioned type, with the characteristic that the panel comprises at least one support portion, which, with two of such coupled panels, when exerting a force in a direction opposite to said downward movement, forms a support against bending of the flexible portion in a direction perpendicular to the plane of the coupled panels. By equipping the panel with such support portion, the advantage is created that the flexible portion can not, or at least less, bend in an undesired direction and that undesired height differences are rendered almost impossible, whereby it can be guaranteed that the panels under all conditions will remain in the same plane with their decorative side.

Herein, said locking parts preferably are formed of parts which engage behind each other by means of a snap movement, which allows a smooth coupling.

In a practical embodiment, said flexible portion is made as a lip, whereas the other locking part, which is intended for cooperating therewith, is made as a tongue-shaped portion which, during interconnecting two of such panels, causes an elastic bending in the lip, such that this tongue-shaped portion can take place behind the lip by means of a snap movement.

Preferably, the support portion is a portion of the core which offers support to the flexible portion, which support prevents a bending of the flexible portion in the coupled condition in a direction perpendicular to the plane of the panels. By making use of a portion of the core as a support point, such support point can be realized in a simple manner.

According to a particular preferred embodiment, the flexible portion and the support portion cooperate with each other by means of a releasable and/or deformable connection. An advantage thereof is that there is no play between the two parts.

According to still another particular characteristic, the panel is characterized in that said flexible portion is suspended such that, apart from a bending in the plane of the panel, it also performs a tilting movement and/or a torsion movement. Such tilting movement offers the advantage that the locking part formed at the flexible part often performs a more controlled movement, which allows a better cooperation with the opposite locking part.

According to another embodiment, the support portion is formed by a fixed portion of the panel, with a contact surface along which the flexible portion can be displaced. In this manner, a controlled displacement is possible, and therefore a bending in an undesired direction is impossible.

Practically, it is preferred that the flexible portion substantially extends in the plane of the floor panel and has a contact surface which is intended to cooperate with a locking part of a coupled floor panel; that the flexible portion, at least at the rear side, as well as at the contact surface, is free in respect to said core; and that, in the direction of its lateral sides, at least at one of its two extremities, it is in connection with the core. In the most preferred embodiment, the flexible portion is at both extremities in connection with the core.

It is clear that the support portion in coupled condition preferably provides for a play-free support function. However, it is also clear that small deviations may occur, wherein, however, a possible play in the support function preferably is kept smaller than 0.3 mm and still better smaller than 0.2 mm. By the play in the support function, it is meant in how much the flexible element can bend out perpendicularly to the plane of the floor panel before coming into contact with a support portion provided in particular to this aim, at least in embodiments wherein they are not in one piece therewith.

Further, for the locking in the plane of the panels and perpendicular to said edges, preferably use is made of hook-shaped parts, which, in the coupled condition of two of such panels, engage behind each other. In a preferred embodiment, said hook-shaped parts are made as a lower hook-shaped part with a flange which protrudes laterally next to the underside of the panel and which is provided with an upwardly directed portion, and an upper hook-shaped part with a flange which protrudes laterally next to the upper side of the panel and which is provided with a downwardly directed portion, wherein said flexible portion is formed at the edge which comprises the lower hook-shaped part, in a material portion of the core situated above this hook-shaped part. Such location of the flexible portion offers a stable construction, as in this manner the flexible portion is situated at a location where the surrounding core is thickest and the hook-shaped parts are not interrupted by cuts, and moreover the locking part formed at the flexible part is situated close to the upper edge of the panel.

It is clear that the panel can comprise a plurality of said flexible portions along the same edge.

The invention is particularly advantageous with embodiments wherein the core, at least at the edge comprising the flexible portion and still better at said two edges, consists of a wood composite, more particularly a wood composite in the form of a board which extends according to the plane of the panel and which is formed by pressing together a mat of wood components, which are adhered to each other by means of a binding agent. Such wood composite allows manufacturing panels in an inexpensive manner, and due to the invention, it is now possible to integrate such "push-lock" couplings therein in a suitable manner. The fact that the material of such boards can shear off easily according to planes parallel to the plane of the board, however, does not have any influence on the couplings described here.

In practice, the core, at least at the edge which comprises the flexible portion, and still better at said two edges, thus also consists of wood fiberboard, more particularly MDF (Medium Density Fiberboard) or HDF (High Density Fiberboard). HDF is preferred, as this imparts a higher strength to the flexible portion. Also, it is not unthinkable to reinforce the core material at the location of the flexible part, for example, by applying additional binding agent in the core material and/or by impregnating the flexible part with a reinforcing agent, and/or by blending-in solid reinforcing components, such as glass fibers.

In the most practical form, the core is made monolithic, for example, in the form of a continuous MDF or HDF board.

The invention is also suitable for being applied in so-called "engineered wood" panels, more particularly panels having a core consisting of a plurality of crosswise-directed elements, for example, wooden laths or the like. By realizing such crosswise-directed element in wood fiberboard at least at one extremity, a coupling part with a flexible portion, as described above, can be integrated therein in an adequate manner, whereas for the other elements any suitable material can be used at choice. For most of the other crosswise-directed elements, thus also cheap wood can be applied.

In the most preferred embodiment, such panel is characterized in that it is rectangular, thus, oblong or square, and that it is provided with coupling parts on all four edges, which coupling parts allow performing a mechanical locking with adjacent panels, such that at all four edges a locking is obtained in the plane of the panels and perpendicular to said edges as well as perpendicular to the plane of the panels. This is of particular importance with floor panels, where, as known, no mutual height differences may occur along the entire circumference.

According to another particular feature, the panel is characterized in that it is provided at two edges with said coupling parts which allow coupling two of such panels to each other by means of a downward movement of one of the panels in respect to the other, whereas the other two edges are provided with coupling parts which allow joining together two of such panels by means of a turning movement. This allows installing such panels according to the so-called, already discussed herein above "angle-push" technique.

According to a second aspect, the invention relates to a panel, wherein this panel comprises a core, an upper side, a bottom side and at least two opposite edges; wherein coupling parts are provided at said two opposite edges; wherein these coupling parts have such a configuration that two of such panels can be coupled to each other by means of a downward movement of one of the panels in respect to the other, such that a locking in the plane of the panels and perpendicular to said edges, as well as perpendicular to the plane of the panels is obtained; wherein the coupling parts at said two edges comprise locking parts ensuring said locking in the direction perpendicular to the plane of the panels, wherein at least one of these locking parts forms part of a flexible portion, made in one piece with said core, which portion extends along the respective edge and can be bent at least in the plane of the panel, as a result of joining together two of such panels; wherein the coupling parts comprise locking parts which ensure said locking in the plane of the panels and perpendicular to the aforementioned edges, and that these locking parts comprise hook-shaped parts which, in the coupled condition of two of such panels, engage one behind the other; wherein said hook-shaped parts are performed as a lower hook-shaped part having a flange which laterally protrudes next to the bottom side of the panel and which is provided with an upwardly directed portion, and an upper hook-shaped part having a flange which laterally protrudes next to the upper side of the panel and which is provided with a downwardly directed portion, characterized in that said flexible portion is formed at the edge comprising the lower hook-shaped part, in a material portion of the core which is situated above this hook-shaped part. As aforementioned, this specific location of the flexible portion clearly offers well-defined advantages.

According to a third aspect, the invention relates to a panel, wherein this panel comprises a core, an upper side, a bottom side and at least two opposite edges; wherein coupling parts are provided at said two opposite edges; wherein these coupling parts have such a configuration that two of such panels can be coupled to each other by means of a downward movement of one of the panels in respect to the other, such that a locking in the plane of the panels and perpendicular to said edges, as well as perpendicular to the plane of the panels is obtained; wherein the coupling parts at said two edges comprise locking parts ensuring said locking in the direction perpendicular to the plane of the panels, wherein at least one of these locking parts forms part of a flexible portion, made in one piece with said core, which portion extends along the respective edge and can be bent at least in the plane of the panel, as a result of joining together two of such panels, characterized in that the flexible portion, with the exception of possible cuts forming a substantial part of a profile formed at the coupling parts, is cut free substantially by only one cut, wherein this cut extends only over a portion of the thickness which the panel is having at the location where the cut is situated. An advantage thereof is that the material of the panel is not weakened across and moreover only one particular cut has to be realized.

According to a fourth aspect, the invention relates to a panel, wherein this panel comprises a core, an upper side, a bottom side and at least two opposite edges; wherein coupling parts are provided at said two opposite edges; wherein these coupling parts have such a configuration that two of such panels can be coupled to each other by means of a downward movement of one of the panels in respect to the other, such that a locking in the plane of the panels and perpendicular to said edges, as well as perpendicular to the plane of the panels is obtained; wherein the coupling parts at said two edges comprise locking parts ensuring said locking in the direction perpendicular to the plane of the panels, wherein at least one of these locking parts forms part of a flexible portion, made in one piece with said core, which portion extends along the respective edge and can be bent at least in the plane of the panel, as a result of joining together two of such panels, characterized in that the flexible portion is bordered at its rear side by a cut, wherein said cut has an open end and a closed end and/or bottom; and that the flexible portion globally diminishes in cross-section in the direction from the open end towards the closed end and/or the bottom. Such configuration allows a smooth movement of the flexible portion.

According to a fifth aspect, the invention relates to a panel, wherein this panel comprises a core, an upper side, a bottom side and at least two opposite edges; wherein coupling parts are provided at said two opposite edges; wherein these coupling parts have such a configuration that two of such panels can be coupled to each other by means of a downward movement of one of the panels in respect to the other, such that a locking in the plane of the panels and perpendicular to said edges, as well as perpendicular to the plane of the panels is obtained; wherein the coupling parts at said two edges comprise locking parts ensuring said locking in the direction perpendicular to the plane of the panels, wherein at least one of these locking parts forms part of a flexible portion, made in one piece with said core, which portion extends along the respective edge and can be bent at least in the plane of the panel, as a result of joining together two of such panels, characterized in that the flexible portion is attached such that it performs only a rotational and/or torsion movement during coupling. As discussed above, such rotational and/or torsion movement offers the advantage that it can take place in a very controlled manner. Preferably, this is realized by performing said connection at the location of the support portion in an unbreakable, however, bendable manner, and possibly such that it can be torn off in part, by which a solely horizontal displacement, such as known from WO 2008/116623 and WO 2009/033623, is completely excluded.

According to a sixth aspect, the invention relates to a panel, wherein this panel comprises a core, an upper side, a bottom side and at least two opposite edges; wherein coupling parts are provided at said two opposite edges; wherein these coupling parts have such a configuration that two of such panels can be coupled to each other by means of a downward movement of one of the panels in respect to the other, such that a locking in the plane of the panels and perpendicular to said edges, as well as perpendicular to the plane of the panels is obtained; wherein the coupling parts at said two edges comprise locking parts ensuring said locking in the direction perpendicular to the plane of the panels, wherein at least one of these locking parts forms part of a flexible portion, made in one piece with said core, which portion extends along the respective edge and can be bent at least in the plane of the panel, as a result of joining together two of such panels, characterized in that the panel is a so-called "engineered wood" panel, more particularly a panel having a core comprising a plurality of crosswise-directed elements, wherein the aforementioned flexible portion is realized along the edge of such crosswise-directed element, wherein this crosswise-directed element consists of wood fiberboard, more particularly MDF or HDF, or of synthetic material. As discussed above, the application of such type of coupling is particularly advantageous in so-called "engineered wood" panels. The wood fiberboard or synthetic material allow that the flexible portion can be realized sufficiently elastic.

BRIEF DESCRIPTION OF THE DRAWINGS

With the intention of better showing the characteristics of the invention, hereafter, as an example without any limitative character, some preferred embodiments are described, with reference to the accompanying drawings, wherein.

DETAILED DESCRIPTION OF VARIOUS EMBODIMENTS

In FIGS. 1 to 12, a panel 1, in this case a floor panel, according to the invention is represented. The panel 1 is rectangular and oblong and consequently comprises a pair of opposite long sides 2-3 and a pair of opposite short sides 4-5, which are determined by the edges 6-7 and 8-9 formed at the panel.

Further, the panel comprises a core 10, an upper side 11 and a bottom side 12.

Figure 1:
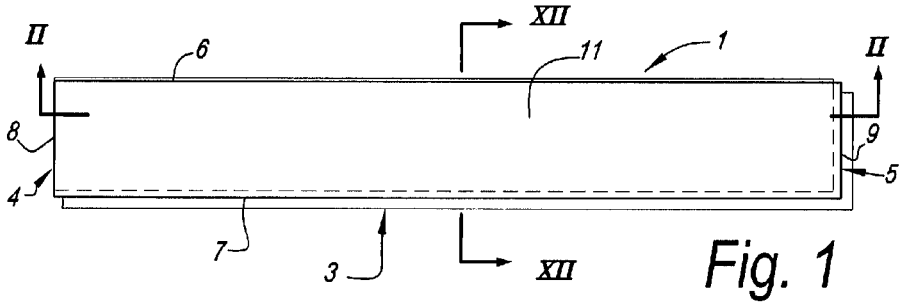
FIG. 1 in plan view represents a panel, more particularly a floor panel, according to the invention.
Figure 2:
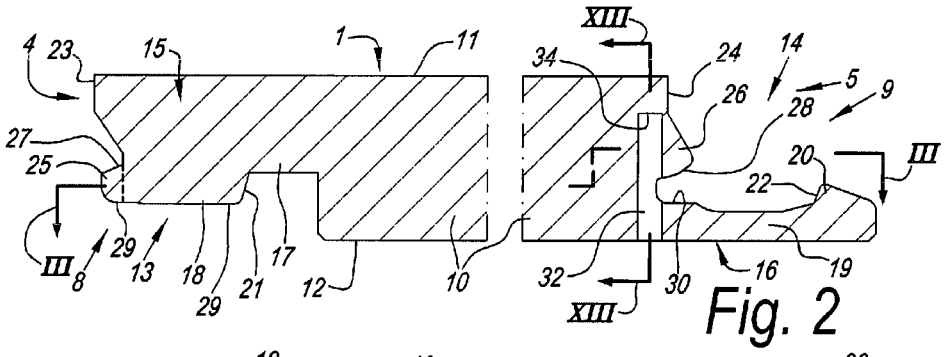
FIG. 2, at a larger scale, represents a view according to line II-II in FIG. 1.
Figure 3:
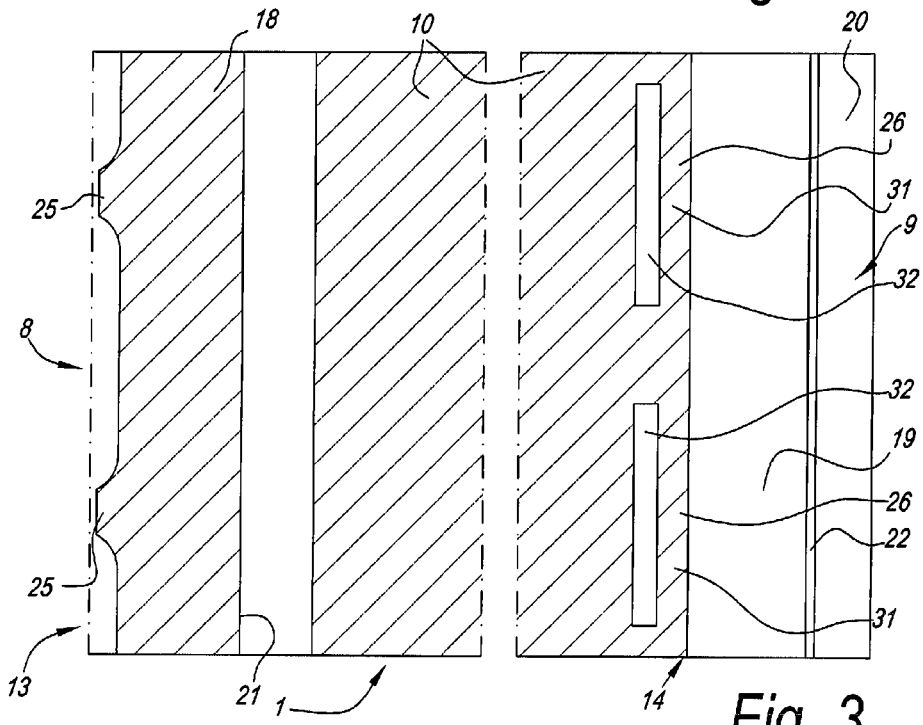
FIG. 3 represents a cross-section according to line III-III in FIG. 2.
Figure 4:
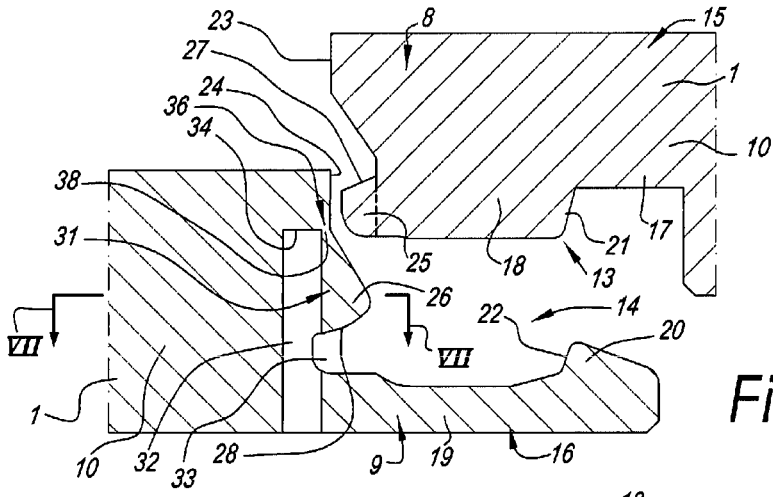
FIGS. 4 through 6 represent how two panels, such as those from FIG. 1, can be coupled to each other by a downward movement.
Figure 5:
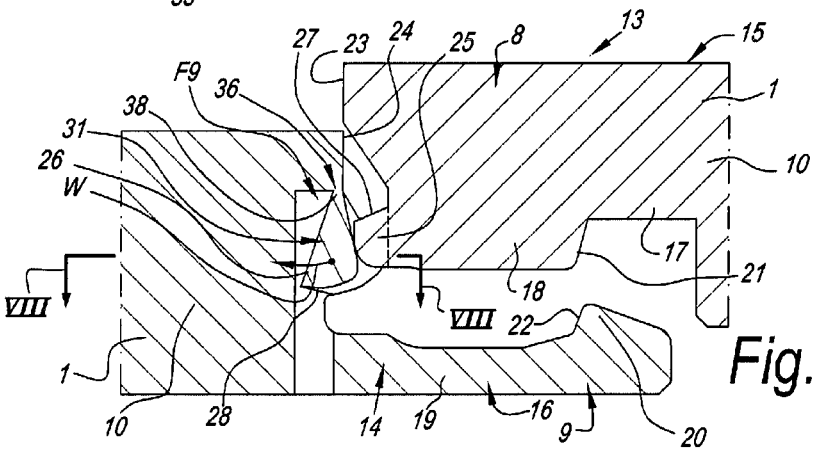
Figure 6:
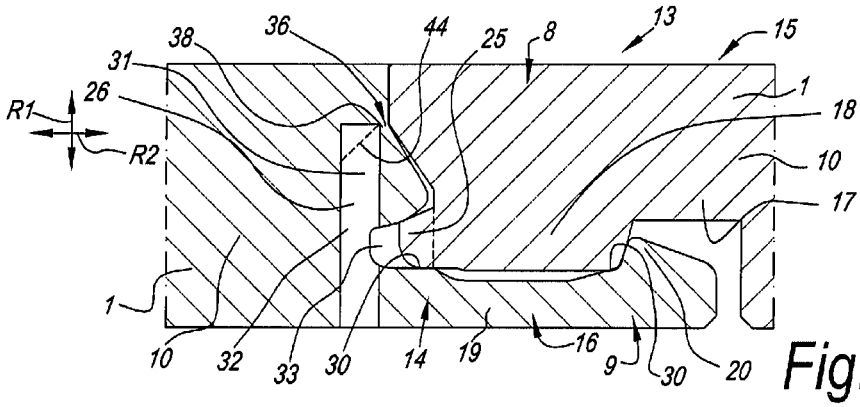
Figure 7:
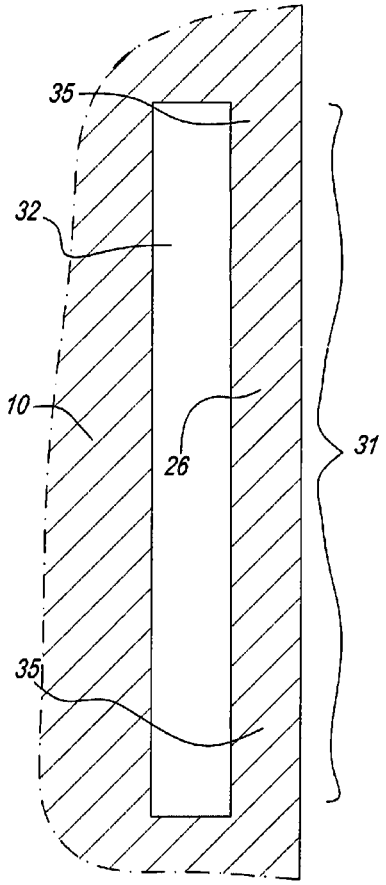
FIGS. 7 and 8 represent cross-sections according to lines VII-VII and VIII-VIII in FIGS. 4 and 5, respectively.

At the opposite edges 8-9, coupling parts 13-14 are provided, which have such a configuration that two of such panels can be coupled to each other at such edges by means of a downward movement of one of the panels 1 in respect to the other, for example, as depicted in FIGS. 4 to 6. These coupling parts 13-14 also are configured such that, in coupled condition, a locking is obtained in the plane of the panels 1 and perpendicular to said edges 8-9, as well as perpendicular to the plane of the panels 1; in other words, in the directions R1 as well as R2, which are indicated in FIG. 6.

In order to obtain the locking in the plane of the panels 1 and perpendicular to said edges 8-9, thus, to obtain in this case that the coupled floor panels 1 are locked against horizontally shifting out of each other, the coupling parts 13-14 are provided with locking parts in the form of hook-shaped parts 15-16, which, in the coupled condition, engage one behind the other. These hook-shaped parts 15-16 comprise an upper hook-shaped part 15 with a flange 17 which laterally protrudes next to the upper side of the panel 1 and which is provided with a downwardly directed portion 18, and a lower hook-shaped part 16 with a flange 19 which laterally protrudes next to the bottom side of the panel 1 and which is provided with an upwardly-directed portion 20. The portions 18 and 20 comprise contact surfaces 21-22, which, in the coupled condition of two of such panels 1, engage one behind the other. In the direction towards each other, the panels 1 comprise contact surfaces 23-24 which are situated in the proximity of their upper edges.

In order to obtain the locking perpendicular to the plane of the coupled panels, the edges 8-9 are provided with locking parts 25 and 26, with respective contact surfaces 27-28, which prevent that the hook-shaped parts 15-16 will come loose from each other. In the other direction, the mutual displacement is prevented in that the hook-shaped parts 15-16 are in contact with each other via one or more contact surfaces 29-30.

In the example, each time at each of the edges two locking parts 25 as well as two locking parts 26 are provided, distributed over the length of the respective edge. However, it is clear that according to not represented variants, also only one locking element per edge might be used, or more than two. At least one of these locking parts, in this case respectively the locking part 26, makes use of or is formed by a flexible portion 31 formed with the aforementioned core 10, wherein said flexible portion extends along the respective edge 9 and is bendable at least in the plane of the panel as a result of joining together two of such panels, such that the locking parts 25-26 can engage behind each other by means of a snap movement. By the term "as a result of joining together", it is meant that during the joining movement a deformation manifests itself at least temporarily.

Figure 8:
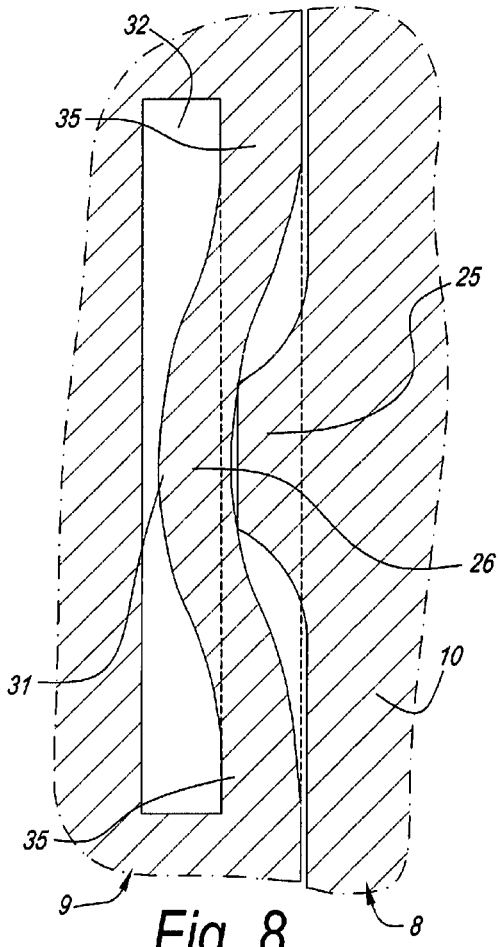

As represented in the example, and as can be seen more particularly in FIG. 8, such flexible portion 31 preferably is performed as an elastically bendable lip.

In order to obtain such portion which is flexible, this portion largely is loosened from the remainder of the material of the core. In the represented embodiment, this is realized by means of at least a cut 32 on the back side of the portion 31, and a cut 33 which in principle may be a component of the coupling profile to be formed.

In this example, the cut 32 does not extend crosswise through the panel, however, up to a certain length and thus also has a most interior side or bottom 34.

The flexible portion 31 extends substantially in the plane of the panel 1 and at its extremities 35 is in connection with the actual core 10. The fact that the flexible portion 31 extends substantially in the plane of the panel 1 and further there is a lateral connection which also occurs substantially in the plane of the panel 1, is in particular of importance when using a core material which has a larger pulling force in its plane than perpendicularly to its plane, which usually is the case with wood composite board. In this manner, then in such case, on the one hand, the necessary flexibility can be guaranteed, whereas, on the other hand, it is excluded that with the occurring forces a tearing-off of the flexible portion of the remainder of the core will occur.

Each respective locking part 25 is preferably made as a tongue-shaped part which, during connecting two of such panels 1, causes an elastic bending in the lip-shaped portion, such that this tongue-shaped portion can take place behind the lip by means of a snap movement. In the example, each tongue-shaped portion is of a length L which is smaller than the length of the lip-shaped portion, such as can be seen in particular in FIG. 8.

The particularity of the invention consists in that the panel 1, at least per flexible portion, comprises a support portion 36, which, with two of such coupled panels 1, when exerting a force in a direction opposed to said downward movement, forms a support against bending of the flexible portion in a direction perpendicularly to the plane of the coupled panels 1.

The support portion 36 is situated at the height of the side of the flexible portion 31, which is situated opposite to the locking side 37 of this flexible portion.

The support portion 36 is a portion of the core which offers a support to the flexible portion 31, which support prevents that the flexible portion can bend out in a direction transverse to the plane of the panel, as a result of which the panels would not remain co-planar.

In the represented example, the cooperation between the flexible portion 31 and the support portion 36 is effected via a releasable and/or deformable connection 38 between a movable portion of the flexible part and another portion of the respective edge of the panel, which offers a permanent support.

It is noted that in the example the aforementioned flexible portion 31 is suspended such that, apart from a bending in the plane of the panel, it can also perform a tilting movement and/or torsion movement W, as indicated in FIG. 5.

Figure 12:
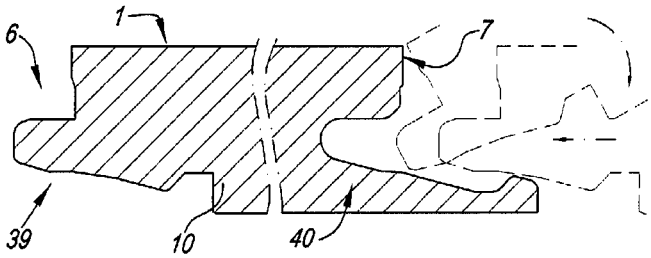
FIG. 12, at a larger scale, represents a cross-section according to line XII-XII in FIG. 1.

The example shows that in the case of oblong panels 1, it is preferred that the above-described coupling parts preferably are situated at the short sides 4-5. Also at the other sides 2-3, as represented in FIG. 12, preferably coupling parts 39-40 are present, which allow performing a mechanical locking with surrounding panels, such that at all four edges a locking is obtained in the plane of the panels and perpendicular to said edges as well as perpendicular to the plane of the panels. These coupling parts 39-40 can be of any kind. Preferably, however, they allow at least joining together two panels 1 at the sides 2-3 concerned by means of a turning movement. In this manner, such panels 1, when being installed in successive rows, can be installed in a very smooth manner by coupling such panel each time with a long side, by means of a turning movement, to the preceding row of panels and by providing, during the turning down of the panel, for that as a result of the downward movement, as represented in FIGS. 4 to 6, automatically a connection is obtained between the short side of the new panel and the short side of the preceding panel installed in the same row.

The functioning of the connection at the short sides is performed in more detail as described in the following. When putting down a panel 1 to be coupled, the flexible portion 31 is impressed by means of the locking part, such as illustrated in FIGS. 5 and 8. When moving it still further down, the flexible portion 31 springs back, as a result of which a locked condition is created, such as illustrated in FIG. 6.

Figure 9:
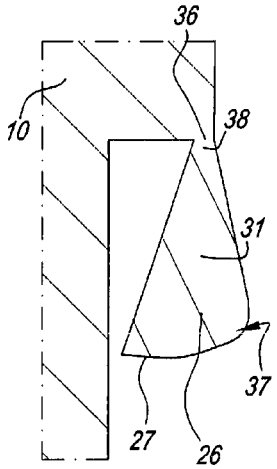
FIGS. 9 to 11, for a number of possible conditions, variants, respectively, represent the portion indicated by F9 in FIG. 5.
Figure 10:
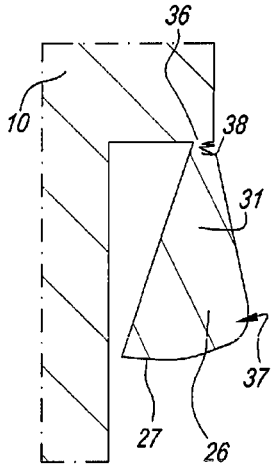
Figure 11:
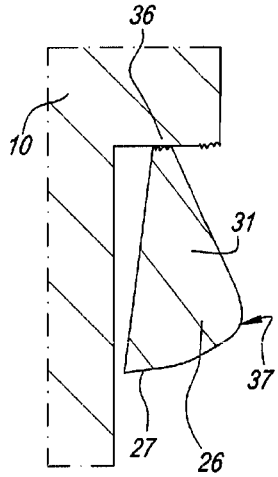

The deformation in the flexible portion 31 can manifest itself in different manners, depending on the location in this part and the strength characteristics of the material, which hereafter will be explained by means of a number of possibilities with reference to FIGS. 9 to 11. FIG. 9 only shows a bending in the connection 38. FIG. 10 shows a partial tearing at the height of the connection 38. In FIG. 11, the connection is completely disrupted, however, the support portion 36 still forms a support.

Figure 13:
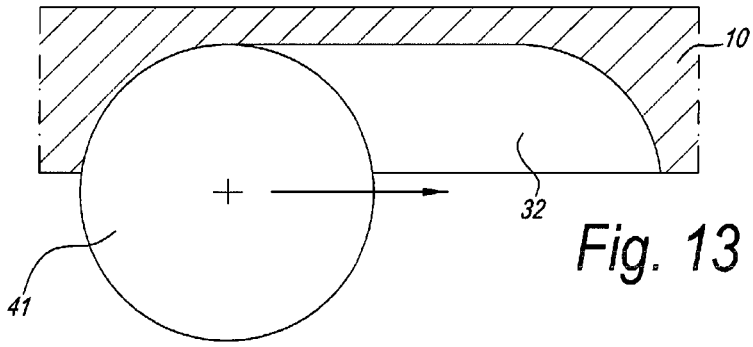
FIG. 13 schematically, in a cross-section according to line XIII-XIII in FIG. 2, represents how the represented recess can be provided in the panel.

In FIG. 13, it is also represented schematically how, for example, the cut 32 can be provided in the panel by means of a rotating cutting tool 41.

Figure 14:
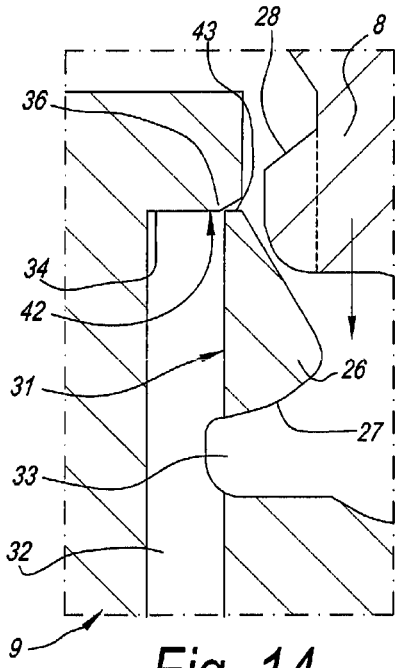
FIGS. 14 to 16 represent a portion of a variant, for three different conditions.
Figure 15:
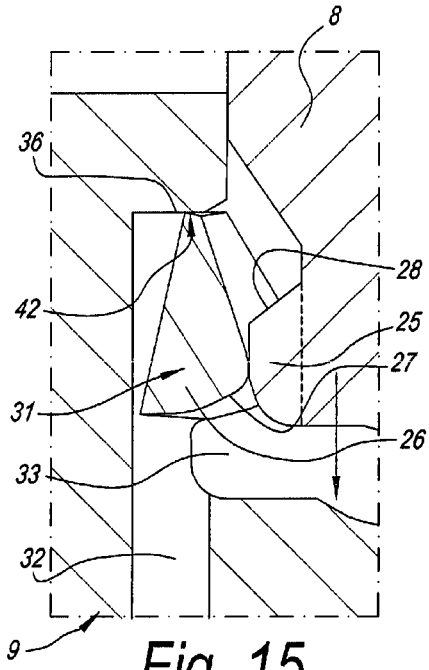
Figure 16:
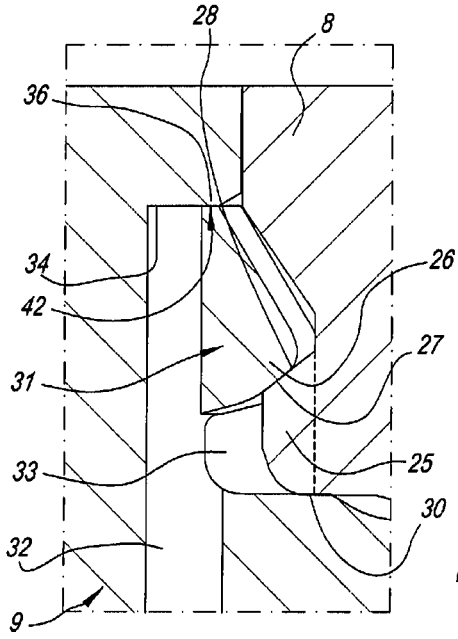

In FIGS. 14 to 16, a variant is represented, wherein the support portion 36 is formed by a fixed portion of the panel 1, with a contact surface 42 along which the flexible portion 31 can be displaced. The difference to the preceding embodiment is that the flexible portion 31 already is completely apart from the support portion 36, right from the start, such as is illustrated in the starting condition of FIG. 14. The configuration then further is such that, when deforming the flexible portion 31 during coupling of two panels 1, first the flexible portion 31 is moved with its edge, in this case, the upper edge 43, under the contact surface 42, as illustrated in FIG. 15, whereas this flexible portion 31 in the finally locked condition of FIG. 16 can not move completely back into the original condition and remains in contact with the contact surface 42, as a result of which the intended support is obtained and remains guaranteed.

Figure 17:
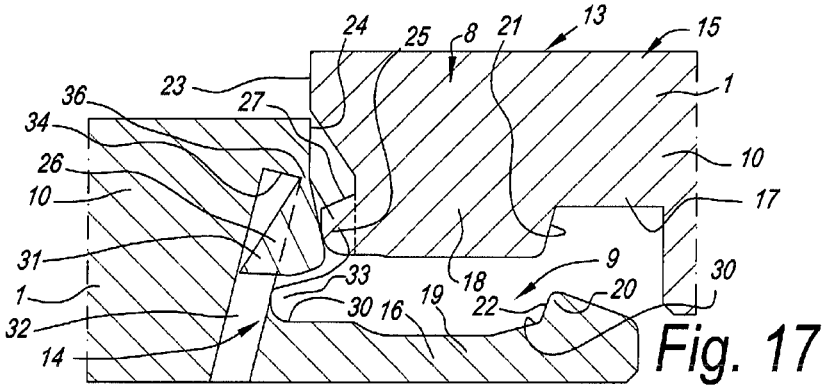
FIG. 17, in a view similar to that of FIG. 5, represents another variant of the invention.

FIG. 17 represents another variant, wherein the cut 32 is not located perpendicularly to the plane of the panel, but is directed obliquely, more particularly with an inclination in the direction as represented. This offers the advantage that the flexible portion 31 can move more inwards, while still having a proper thickness.

It is clear that different variants are possible. In the example, both locking parts 25-26 are performed as portions which do not extend continuously over the length of the edges concerned. According to a variant, the edge at which one of these locking parts is present, indeed can be provided with a continually extending profile, for example, by applying the tongue-shaped portion in the flexible portion, analogous to the embodiment which is known from FIGS. 1 to 3 of document WO 2008/116623.

In FIG. 6, a variant of the cut 32 is shown in dashed line 44, being inclined from the bottom. Consequently, the risk of tearing-in towards the left can be reduced.

In the figures, the panels 1 are represented with a unitary core. However, this must not necessarily be the case. For example, the core may consist of a plurality of layers and/or parts, wherein the respective material of the core situated at the edge then comprises the flexible portion made in one piece thereof, in a manner already discussed in the introduction.

From the embodiments represented in the figures, it is clear that those also form examples of the other aspects of the invention.

Further, it is clear that the panels, irrespective according to which of the aforementioned aspects, certainly in the case of a floor panel, usually will be provided with a decorative layer at the upper side. At the bottom side, too, possibly a backing layer may be provided. This may relate to any materials. A number of examples are: laminate consisting of one or more layers, for example, of the DPL type (Direct Pressure Laminate) or HPL type (High Pressure Laminate); a decor printed directly on the panel, whether or not provided with additional top layers and/or additional bottom layers; veneer or a decorative layer formed of wood parts; vinyl, linoleum, or the like; stone; cork or a product on the basis of cork; a carpet layer; a foil or film.

Preferably, the portions 18 and 20 are configured such, for example, are made so low that the panels at the edges 8-9 can not only be joined together by the aforementioned downward movement, but can also be joined together and/or turned out of each other by means of a turning movement. Whether or not in combination herewith, the profiles at the edges 8-9 can also be configured such that two of such panels can be joined together by means of a shifting and snap movement. This, too, is possible in combination with any one of the aforementioned aspects of the invention.

Further, it is also clear that in all coupling parts which are applied in panels according to the invention, a so-called pre-tension can be built in, by which the panels in coupled condition are pulled towards each other and adjoin well against each other. The basic principle of pre-tension is known as such from WO 97/47834.

Further, it is clear that the flexible portion 31 can be configured such that the portion 18 in coupled condition is pressed with its contact surfaces 29 with a permanent force onto the contact surfaces 30.

Finally, it is noted that all independent aspects can be combined at choice in the same embodiment. Also all partial aspects described above by means of the figures can be applied at choice in panels of the second to the sixth aspect, without requiring that the main idea of the first aspect has to be applied in such combination.

For clarity's sake, it is noted that, when it is stated that the flexible portion is bendable "in the plane of the panel", a bending occurs, viewed in a theoretical sectional plane parallel to the plane of the panel. This does not necessarily mean that the flexible portion as such is movable in horizontal direction. In the embodiment of FIG. 5, the flexible portion in fact performs a tilting and bending movement and thus in principle is not displaced horizontally, but rather rotates.

By a "downward movement", it is meant that in a cross-section such as in FIGS. 4 to 6, the one panel moves relatively in respect to the other with the hook-shaped parts with their open sides towards each other. This may be in a substantially plan-parallel manner, however, also as the result of applying the aforementioned "angle-push" technique. Also, it is noted that the downward movement may or may not be performed with a slight displacement in transverse direction, thus, horizontally in FIG. 5, as a result of mutual lateral contacts.

It is also noted that in the above description and the following claims, a number of terms, such as "downward", "lower", "upper", "bottom side" and "upper side" are being related to floor panels, and that it is clear that with other panels, which are not lying substantially flat, these terms have to be interpreted similarly, however, then relative to the plane of the panels.

The present invention is in no way limited to the embodiments described by way of example and represented in the figures; on the contrary, such panels may be realized in various forms and embodiments, without leaving the scope of the invention. For example, the invention is not restricted to floor panels and may be applied in any other field of application, such as, amongst others, in wall panels, ceiling panels, furniture panels, and so on.

The invention claimed is:

1. A floor panel comprising a core, an upper side, a bottom side and at least two opposite edges, the panel having coupling parts provided at said two opposite edges and having a configuration such that two of such panels can be coupled to each other by means of a downward movement of one of the panels in respect to the other, such that a locking is obtained in the plane of the panels and perpendicular to said edges, as well as perpendicular to the plane of the panels, the coupling parts at said two edges including locking parts ensuring said locking in the direction perpendicular to the plane of the panels and at least one of the locking parts forms part of a flexible portion made in one piece with said core, said flexible portion extending along the respective edge and being bendable at least in the plane of the panel, as a result of connecting two of such panels, wherein the panel includes at least one support portion, which, with two of such coupled panels, when exerting a force in a direction opposed to said downward movement, forms a support against bending of the flexible portion in a direction transverse to the plane of the coupled panels;

wherein the support portion is formed by a fixed portion of the panel and has a contact surface along which the flexible portion is displaceable.

2. The panel of claim 1, wherein said locking parts are formed from parts which engage behind each other by means of a snap movement.

3. The panel of claim 1, wherein said flexible portion defines a lip, whereas another locking part, which is intended to work in conjunction therewith, defines a tongue-shaped portion, which, during joining two of such panels, causes an elastic bending in the lip, such that the tongue-shaped portion can take place behind the lip by means of a snap movement.

4. The panel of claim 1, wherein the support portion is a portion of the core supporting the flexible portion, said support portion preventing the flexible portion in a coupled condition from bending out in a direction transverse to the plane of the panels.

5. The panel of claim 1, wherein the flexible portion and the support portion cooperate with each other by means of a releasable or deformable connection.

6. The panel of claim 1, wherein said flexible portion is suspended such that, apart from a bending in the plane of the panel, the flexible portion performs a tilting or torsion movement.

7. The panel of claim 1, wherein the flexible portion extends substantially in the plane of the floor panel and has a contact surface which is intended for cooperating with a locking part of a coupled floor panel; the flexible portion, at least at the rear side and at the contact surface, is free in respect to said core; and that, in the direction of the lateral sides thereof, at least at one of its two extremities, is in connection with the core.

8. The panel of claim 7, wherein the flexible portion is at both extremities in connection with the core.

9. The panel of claim 1, wherein the coupling parts comprise locking parts, which ensure said locking in the plane of the panels and perpendicular to said edges, and that these locking parts comprise hook-shaped parts, which, in the coupled condition of two of such panels, engage behind each other.

10. The panel of claim 1, wherein said hook-shaped parts are performed as a lower hook-shaped part with a flange which protrudes laterally next to the underside of the panel and which is provided with an upwardly directed portion, and an upper hook-shaped part with a flange which protrudes laterally next to the upper side of the panel and which is provided with a downwardly directed portion, wherein said flexible portion is formed at the edge which comprises the lower hook-shaped part, in a material portion of the core situated above this hook-shaped part.

11. The panel of claim 1, wherein the panel comprises a plurality of said flexible portions along the same edge.

12. The panel of claim 1, wherein the core, at least at the edge comprising the flexible portion or at said two edges, consists of a wood composite in the form of a board extending according to the plane of the panel and which is formed by pressing together a mat of wood components, which are adhered to each other by means of a binding agent.

13. The panel of claim 1, wherein the core, at least at the edge comprising the flexible portion or at said two edges, consists of wood fiberboard.

14. The panel of claim 1, wherein the core, at least at the edge comprising the flexible portion, or at said two edges, is selected from the group consisting of MDF and HDF.

15. The panel of claim 1, wherein the core thereof is made monolithic, and is made from a material selected from the group consisting of MDF and HDF.

16. The panel of claim 1, wherein the panel has a shape selected from the group consisting of rectangular, oblong or square, and wherein the panel is provided with coupling parts on all four edges, the coupling parts allow performing a mechanical locking with adjacent panels, such that at all four edges a locking is obtained in the plane of the panels and perpendicular to said edges as well as perpendicular to the plane of the panels.

17. The panel of claim 16, wherein the panel is provided at two edges with coupling parts which allow coupling two of such panels to each other by means of a downward movement of one of the panels in respect to the other, whereas the other two edges are provided with coupling parts which allow joining together two of such panels by means of a turning movement.

18. The panel of claim 1, wherein the flexible portion has an edge surface in contact with the contact surface, the edge surface being opposite the contact surface.

19. A floor panel, the panel comprising a core, an upper side, a bottom side and at least two opposite edges, the panel having coupling parts provided at said two opposite edges and having a configuration such that two of such panels can be coupled to each other by means of a downward movement of one of the panels in respect to the other, such that a locking in the plane of the panels and perpendicular to said edges, as well as perpendicular to the plane of the panels is obtained, the coupling parts at said two edges including locking parts ensuring said locking in the direction perpendicular to the plane of the panels, and at least one of these locking parts forms part of a flexible portion, made in one piece with said core, the portion extending along the respective edge and bendable at least in the plane of the panel, as a result of joining together two of such panels, the coupling parts including locking parts which ensure said locking in the plane of the panels and perpendicular to the aforementioned edges, and that these locking parts define hook-shaped parts which, in the coupled condition of two of such panels, engage one behind the other, the hook-shaped parts are performed as a lower hook-shaped part with a flange protruding laterally next to the underside of the panel and provided with an upwardly directed portion, and an upper hook-shaped part with a flange protruding laterally next to the upper side of the panel and provided with a downwardly directed portion, wherein said flexible portion is formed at the edge comprising the lower hook-shaped part in a material portion of the core situated above the hook-shaped part.

20. A floor panel comprising a core, an upper side, a bottom side and at least two opposite edges, the panel having coupling parts provided at said two opposite edges, and having a configuration such that two of such panels can be coupled to each other by means of a downward movement of one of the panels with respect to the other, such that a locking in the plane of the panels and perpendicular to said edges, as well as perpendicular to the plane of the panels is obtained, the coupling parts at said two edges including locking parts ensuring said locking in the direction perpendicular to the plane of the panels, and at least one of these locking parts forms part of a flexible portion made in one piece with said core, and extending along the respective edge and bendable at least in the plane of the panel, as a result of joining together two of such panels, and wherein the flexible portion, with the exception of possible cuts forming a substantial part of a profile formed at the coupling parts, is cut free substantially by only one cut, the cut extending only over a portion of the thickness of the panel at the location where the cut is situated;

wherein hook-shaped parts are performed as a lower hook-shaped part with a flange which protrudes laterally next to the underside of the panel and which is provided with an upwardly directed portion, and an upper hook-shaped part with a flange which protrudes laterally next to the upper side of the panel and which is provided with a downwardly directed portion, wherein said flexible portion is formed at the edge which comprises the lower hook-shaped part, in a material portion of the core situated above this hook-shaped part.

21. A floor panel comprising a core, an upper side, a bottom side and at least two opposite edges, the panel having coupling parts provided at said two opposite edges and having a configuration such that two of such panels can be coupled to each other by means of a downward movement of one of the panels in respect to the other, such that a locking in the plane of the panels and perpendicular to said edges, as well as perpendicular to the plane of the panels is obtained, the coupling parts at said two edges including locking parts ensuring said locking in the direction perpendicular to the plane of the panels, at least one of these locking parts forms part of a flexible portion made in one piece with said core, and extending along the respective edge and bendable at least in the plane of the panel, as a result of joining together two of such panels, wherein the flexible portion is bordered at its rear side by a cut, wherein said cut has an open end and a closed end or a bottom and the flexible portion globally diminishes in cross-section in the direction from the open end towards the closed end or the bottom;

wherein hook-shaped parts are performed as a lower hook-shaped part with a flange which protrudes laterally next to the underside of the panel and which is provided with an upwardly directed portion, and an upper hook-shaped part with a flange which protrudes laterally next to the upper side of the panel and which is provided with a downwardly directed portion, wherein said flexible portion is formed at the edge which comprises the lower hook-shaped part, in a material portion of the core situated above this hook-shaped part.

22. A floor panel comprising a core, an upper side, a bottom side and at least two opposite edges, the panel having coupling parts provided at said two opposite edges, the coupling parts having a configuration such that two of such panels can be coupled to each other by means of a downward movement of one of the panels in respect to the other, such that a locking in the plane of the panels and perpendicular to said edges, as well as perpendicular to the plane of the panels is obtained, the coupling parts at said two edges comprising locking parts ensuring said locking in the direction perpendicular to the plane of the panels, at least one of these locking parts forms part of a flexible portion made in one piece with said core, and extending along the respective edge and bendable at least in the plane of the panel, as a result of joining together two of such panels, wherein the flexible portion is attached such that the flexible portion performs only a rotational or torsion movement during coupling;

wherein hook-shaped parts are performed as a lower hook-shaped part with a flange which protrudes laterally next to the underside of the panel and which is provided with an upwardly directed portion, and an upper hook-shaped part with a flange which protrudes laterally next to the upper side of the panel and which is provided with a downwardly directed portion, wherein said flexible portion is formed at the edge which comprises the lower hook-shaped part, in a material portion of the core situated above this hook-shaped part.

23. A floor panel comprising a core, an upper side, a bottom side and at least two opposite edges, the panel having coupling parts provided at said two opposite edges, the coupling parts having a configuration such that two of such panels can be coupled to each other by means of a downward movement of one of the panels in respect to the other, such that a locking in the plane of the panels and perpendicular to said edges, as well as perpendicular to the plane of the panels is obtained, the coupling parts at said two edges including locking parts ensuring said locking in the direction perpendicular to the plane of the panels, at least one of these locking parts forms part of a flexible portion, made in one piece with said core, and extending along the respective edge and bendable at least in the plane of the panel, as a result of joining together two of such panels, wherein the core comprises a plurality of crosswise-directed elements, and said flexible portion is realized along the edge of such crosswise-directed element, the crosswise-directed element is selected from the group consisting of MDF, HDF, and synthetic material;

wherein hook-shaped parts are performed as a lower hook-shaped part with a flange which protrudes laterally next to the underside of the panel and which is provided with an upwardly directed portion, and an upper hook-shaped part with a flange which protrudes laterally next to the upper side of the panel and which is provided with a downwardly directed portion, wherein said flexible portion is formed at the edge which comprises the lower hook-shaped part, in a material portion of the core situated above this hook-shaped part.

* * * * *

UNITED STATES PATENT AND TRADEMARK OFFICE

CERTIFICATE OF CORRECTION

PATENT NO. : 8,615,953 B2
APPLICATION NO. : 13/378228
DATED : December 31, 2013
INVENTOR(S) : Cappelle It is certified that error appears in the above-identified patent and that said Letters Patent is hereby corrected as shown below:

Title Page Left-hand Column Item [22]
Change Filing Date from "Jun. 20, 2010" to --Jun. 22, 2010--

Signed and Sealed this
Eighteenth Day of February, 2014

Michelle K. Lee

Michelle K. Lee
*Deputy Director of the United States Patent and Trademark Office*